US007823523B2

(12) United States Patent
Perez

(10) Patent No.: US 7,823,523 B2
(45) Date of Patent: Nov. 2, 2010

(54) PORTABLE DRY DOCK SYSTEM AND METHOD FOR COMMERCIAL SERVICING OF RECREATIONAL VESSELS IN INLAND WATERWAYS

(76) Inventor: Marcelo Alejandro Perez, 24 Prescott Place, Franklin, TN (US) 37069

( * ) Notice: Subject to any disclaimer, the term of this patent is extended or adjusted under 35 U.S.C. 154(b) by 9 days.

(21) Appl. No.: 12/237,006

(22) Filed: Sep. 24, 2008

(65) Prior Publication Data

US 2009/0101054 A1 Apr. 23, 2009

Related U.S. Application Data

(60) Provisional application No. 60/981,715, filed on Oct. 22, 2007.

(51) Int. Cl.
*B63C 1/02* (2006.01)

(52) U.S. Cl. ..... 114/45; 114/222

(58) Field of Classification Search ..... 114/44, 114/45, 222

See application file for complete search history.

(56) References Cited

U.S. PATENT DOCUMENTS 6,155,190 A * 12/2000 Cavanagh ..... 114/45
2001/0006590 A1* 7/2001 Bishop et al. ..... 405/3
2007/0277718 A1* 12/2007 Towley et al. ..... 114/44

* cited by examiner

*Primary Examiner*—Stephen Avila

(57) ABSTRACT

A Portable Dry Dock (PDD) system designed for commercial servicing of recreational vessels (RVs) in inland waterways (IW). This PDD is disassembled and transported from one IW to another. This PDD was designed specifically to improve the efficiency in the most typical maintenance jobs in RVs. The convenient layout of the equipment and the closed environment of the PDD reduce the execution time and improve the working conditions. The isolated environment created by the superstructure, deck and roof of the PDD significantly reduces the environmental impact. The isolated environment inside the PDD is controlled in temperature and humidity. The air filtering and waste water collection systems remove dust and other substances coming from the operation, stopping pollutants from getting into the IW.

9 Claims, 8 Drawing Sheets

PORTABLE DRY DOCK SYSTEM AND METHOD FOR COMMERCIAL SERVICING OF RECREATIONAL VESSELS IN INLAND WATERWAYS

FIELD OF THE INVENTION

The present invention relates generally to a portable dry dock that is transported to different inland waterways to service local recreational vessels. More specifically, the present invention relates to a very efficient system to service recreational vessels with minimal environmental impact.

BACKGROUND OF THE INVENTION

Recreational vessels (RV) are often serviced in boatyards. It is very common to see boatyards with a very limited infrastructure to support an efficient work flow. In fact, most of the boatyards have challenging conditions for workers and customers that reduce the quality of the service and ultimately increases the cost of the operation.

Over 90% of inland waterways (IW) have no access to boatyards or service facilities within a distance of 10 miles. High property values in the surroundings of IW limit the options for boat owners when they have to service their boats. Vessels over 28 ft are costly to remove from the water and transport for servicing.

What is needed, therefore, is a portable dry dock that is optimized for servicing RVs. This PDD is transported to the site and provides a very efficient and cost-effective working environment for typical maintenance operations on RVs, including cleaning, repairing and painting.

SUMMARY OF THE INVENTION

In one specific embodiment, the PDD comprises of modular sections that are disassembled, transported and re-assembled in different waterways. Each section consists of buoyant members that are connected with a series of trusses to support the superstructure. The superstructure has a sealed working area where temperature and humidity are controlled. The RV is positioned in this working area for the service operation. Waste material coming from the operation is processed so contaminants are properly trapped and stored for proper disposal.

To load the RV on the PDD, the PDD is submerged by injecting water ballast into the buoyant members. An elevated deck supports the equipment necessary for the service operation. When the PDD is submerged, the equipment stays dry on the elevated deck.

The RV is secured on the PDD deck with the use of a lifting frame and hull supports.

With the aid of a robotic arm, multiple operations are performed on the hull, including cleaning, repairing and painting.

This unique combination of features integrated in the PDD system, maximizes work efficiency, improves the quality, and reduces the cost, the time, and the environmental impact of the service operation.

In one implementation, the PDD is configured with different number of buoyancy members depending on the lifting capacity that is needed.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DRAWING REFERENCE NUMERALS

Figure 1:
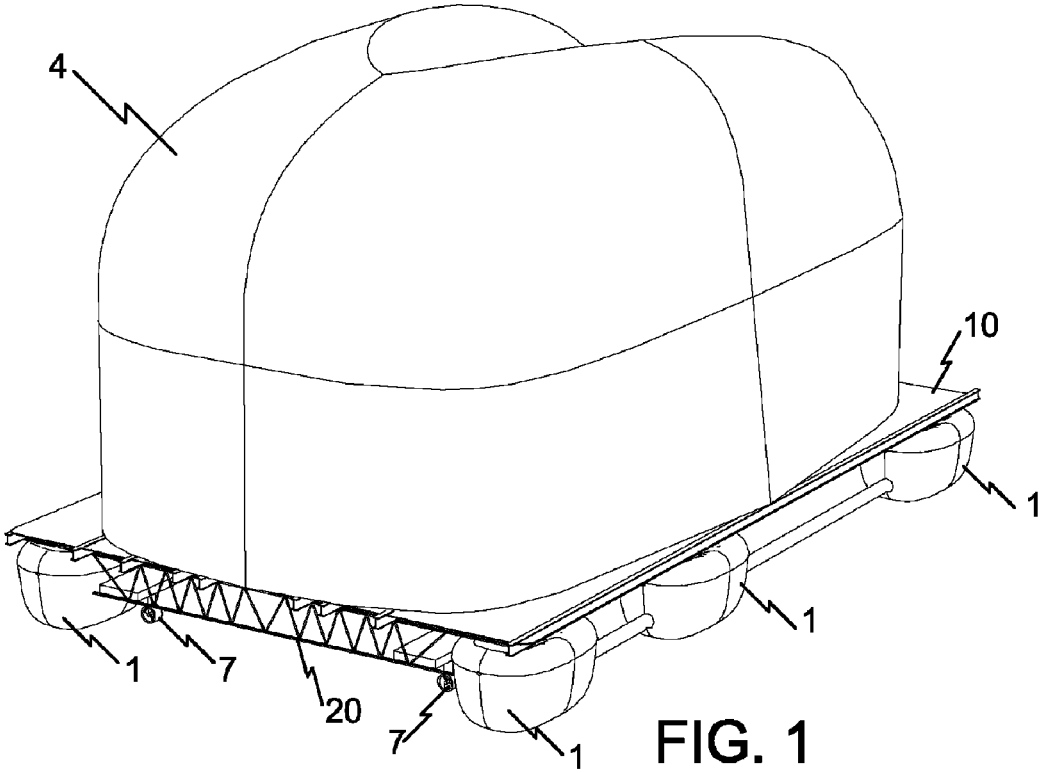
FIG. 1 is a perspective view (port side) with the roof fully closed.
Figure 2:
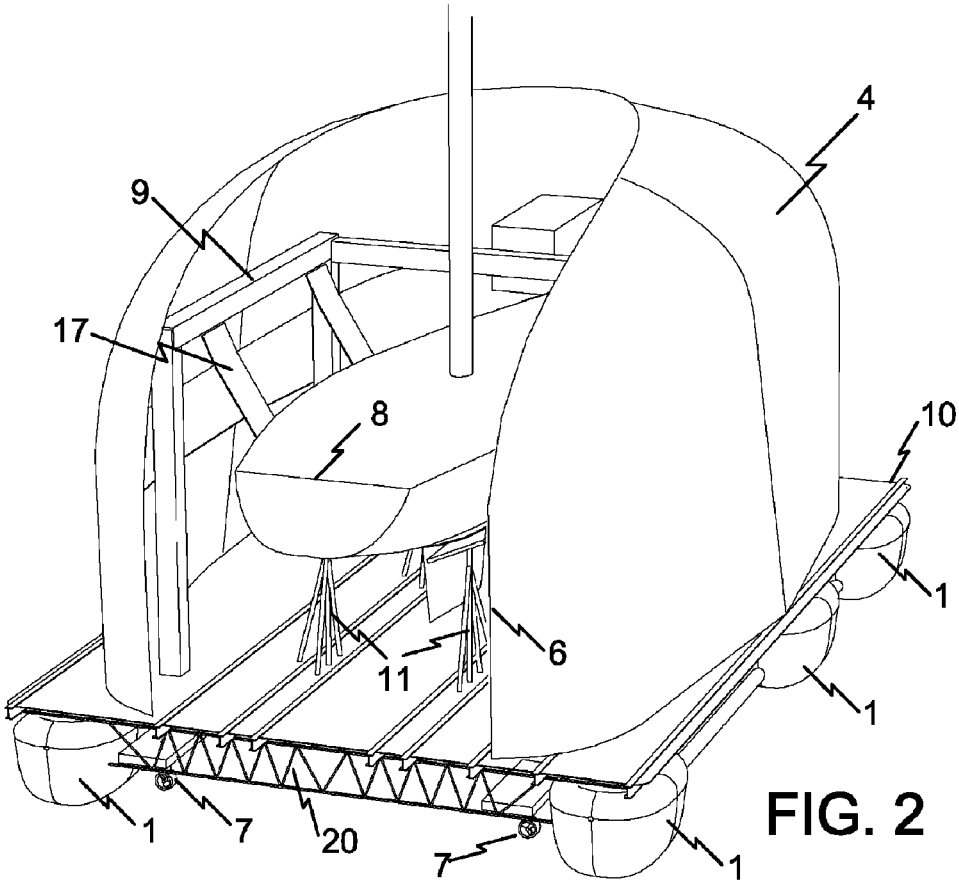
FIG. 2 is a perspective view (stern side). In this case, the PDD is shown with a recreational vessel inside before closing the roof.

1 Primary buoyant members
2 Secondary buoyant members
3 Roof of the superstructure
4 Superstructure
5 Cabin
6 Aft door
7 Thrusters
8 Recreational vessel (RV)
9 Lifting frame
10 Deck
11 Hull supports
12 Hull surface treatment device
13 Compress air conduits
14 Air Compressor
15 Electrical Generator
16 Air conditioning equipment (including charcoal filtering)
17 Lifting straps
18 Water intake/discharge command rod
19 Deck beams
20 Interconnecting truss
21 Water intake/discharge valve
22 Second level deck
23 Chambers
24 Utility boat
25 Waste water tank
26 Waste water intake For clarity of the drawings, components such as navigation lights, mooring cleats, safety equipment, anchoring devices, and stairs are not shown in the drawings.

DETAILED DESCRIPTION OF THE ILLUSTRATED EMBODIMENTS

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

FIGS. 1 to 8 show a PDD system according to the invention which is generally comprised of a set of buoyant members 1 with a series of beams and interconnecting trusses to create the floating structure of the PDD.

Each buoyant member and interconnecting structure is modular. With this modularity, the PDD can be disassembled for easy transportation. Furthermore, this modularity brings the flexibility to grow or reduce the structure based on the particular need. For example, When the PDD is needed to work on small boats, a set of 4 buoyant members may have sufficient lift. If the PDD is needed to lift a bigger boat, more buoyant members can be added to the structure to increase the lifting capacity and/or overall dimensions of the deck (10).

Figure 4:
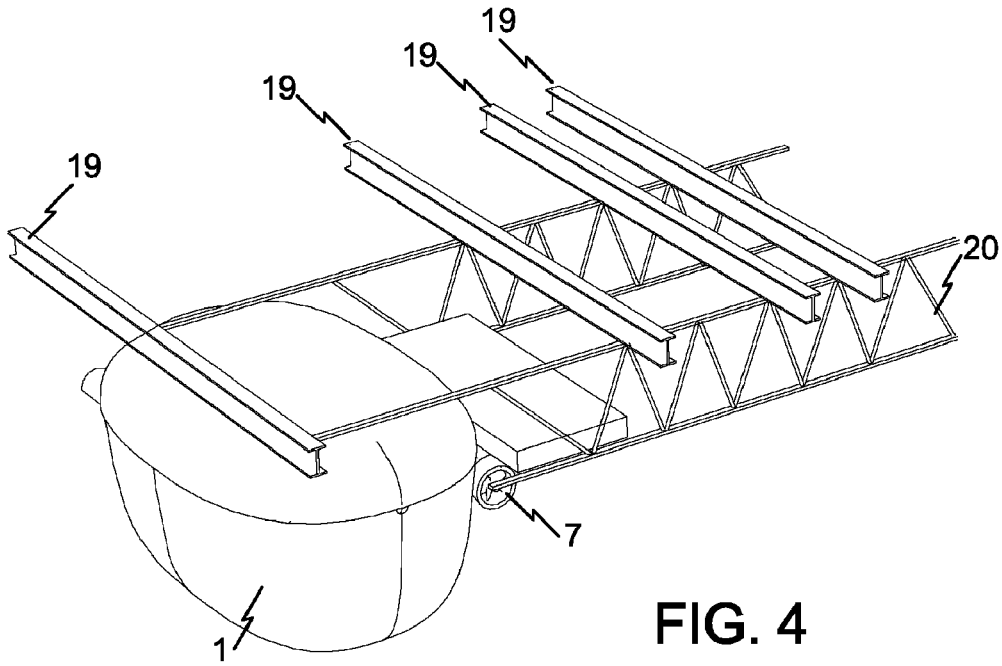
FIG. 4 is a perspective of one of the modules, including a section of the truss between the two primary buoyant members of the PDD.
Figure 5:
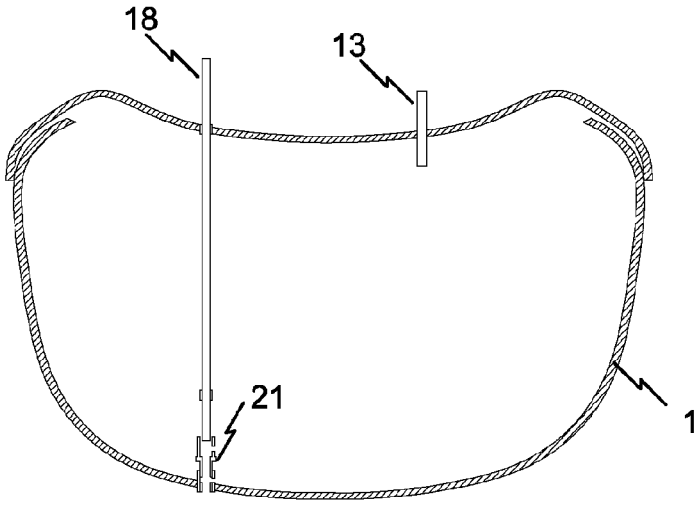
FIG. 5 is a section of one of the primary buoyant members.
Figure 6:
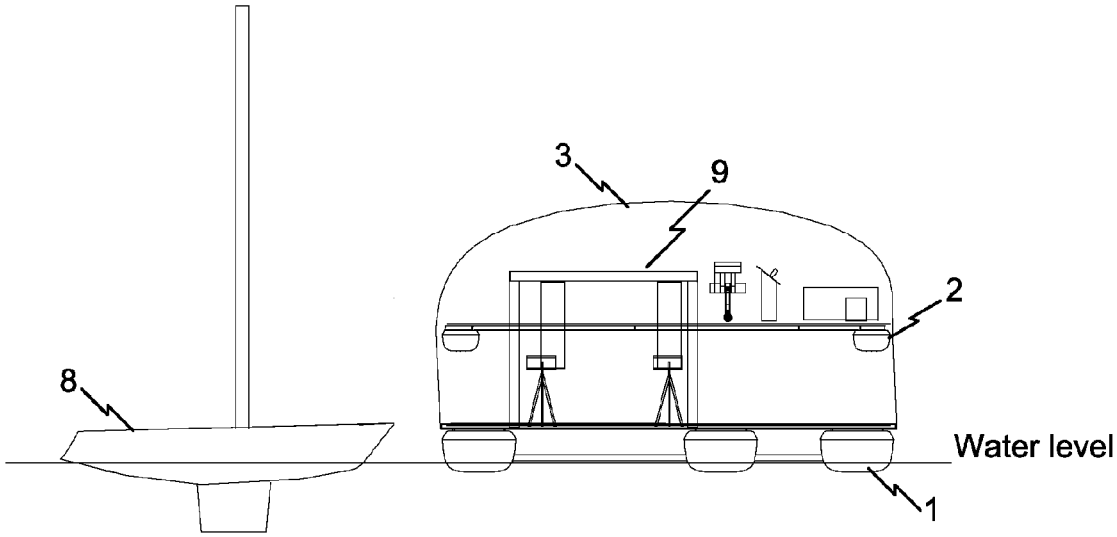
FIG. 6 through 9 show the sequence followed to lift a RV from the water.
Figure 7:
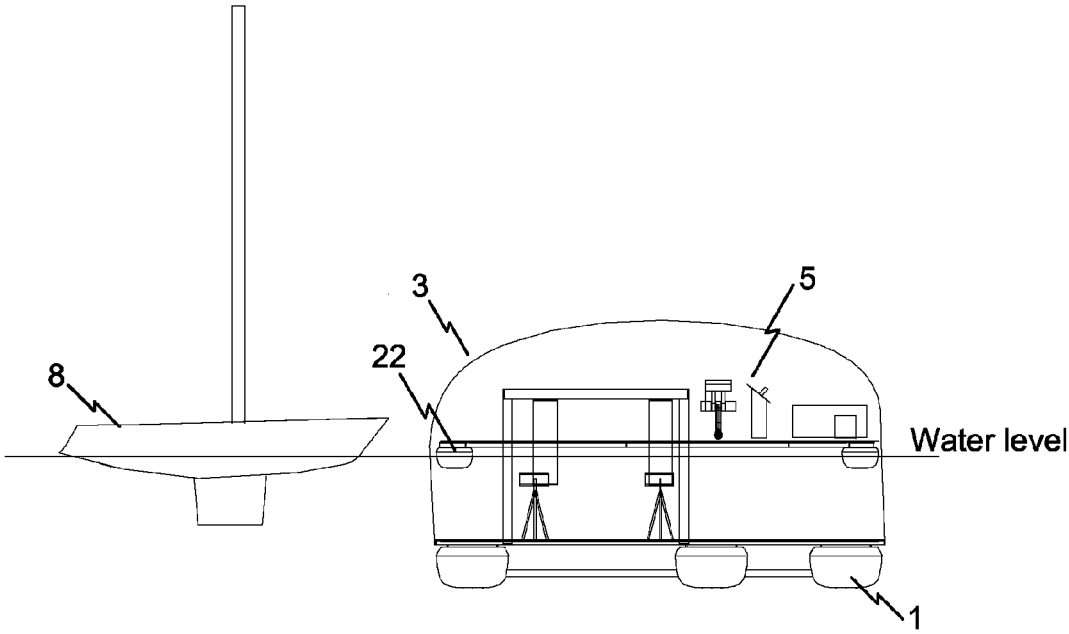
Figure 8:
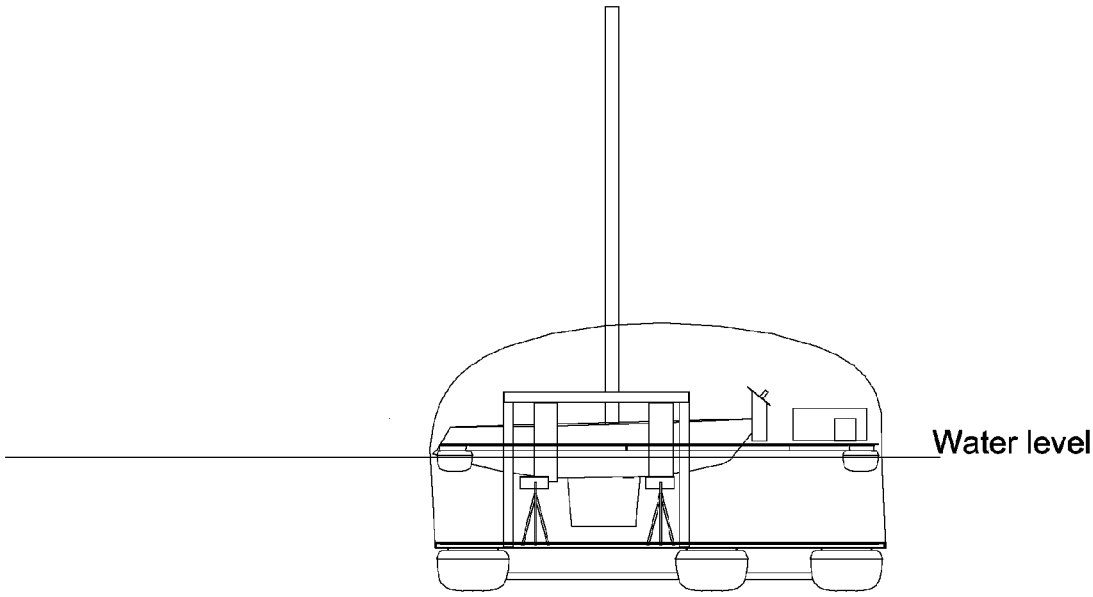
Figure 9:
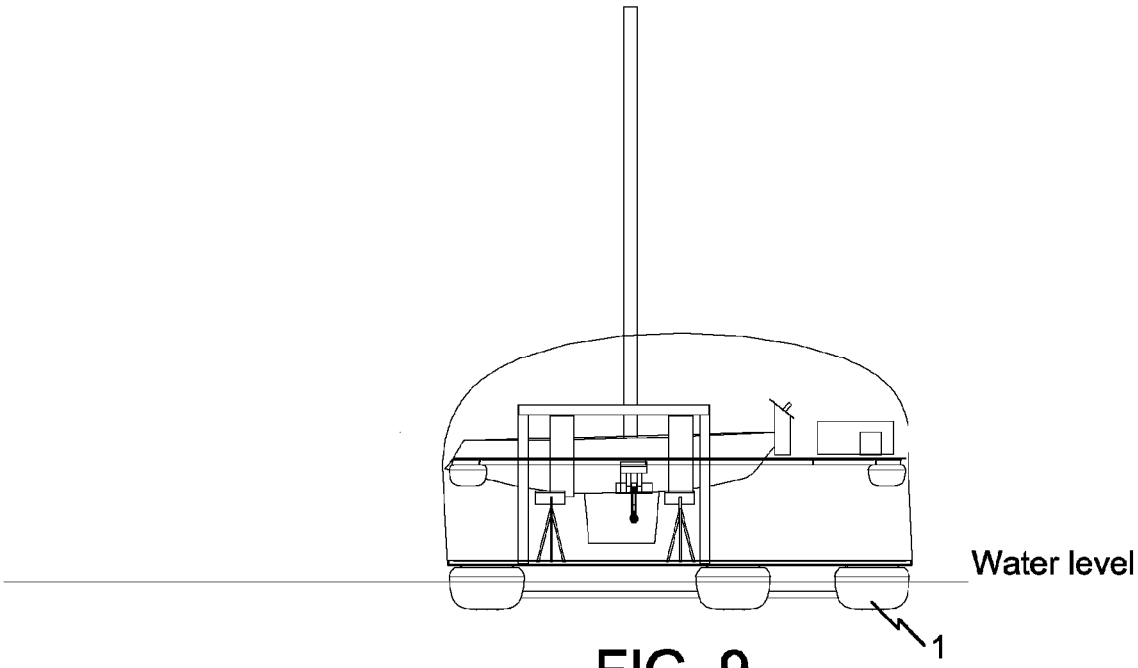

Each buoyant member 1 can be flooded or emptied at will. FIG. 5 shows a section of one of these buoyant members. Each buoyant member 1 (or chamber) is a water tight compartment that has a discharge valve 21 to allow water to come in and out of the chamber. Discharge valves 21 are present in each of the chambers. They are activated manually or with the aid of electrical or pneumatic actuators through the water intake/discharge command rod 18. To flood the chamber with water, vacuum is created in the compress air conduits 13 with a vacuum pump. This vacuum accelerates the intake of water into the chamber 1. To empty the chamber, compressed air is injected through the compressed air conduits 13 to discharge the water from the chamber 1. By changing the amount of water inside the chambers 1, it is possible to regulate the buoyancy of the PDD. The buoyant members 1 provide adequate buoyancy and stability when the PDD is afloat. When the PDD is semi-submerged, there is a second set of buoyant members 2 that improves the stability of the PDD. This PDD is a multi-hull vessel that can be submerged and positioned below the RV 8 to be serviced. Each buoyant member 1 is rigidly attached to the next, forming a single structure. This detail is shown in FIG. 4. The interconnecting trusses 20 are the support for the deck and superstructure. Each of the sections of the PDD is modular and can be disassembled into the individual chambers 1 for easy transportation.

The PDD includes a shell consisting of a superstructure 4 with a removable roof 3. This shell isolates the work area from the elements. It provides a controlled environment to service the RV 8. This fully enclosed shell is designed to perform painting, hull cleaning and other servicing activities with minimal environmental impact and maximum efficiency. A removable roof 3 and aft doors allow moving RVs 8 in and out of the PDD.

Figure 3:
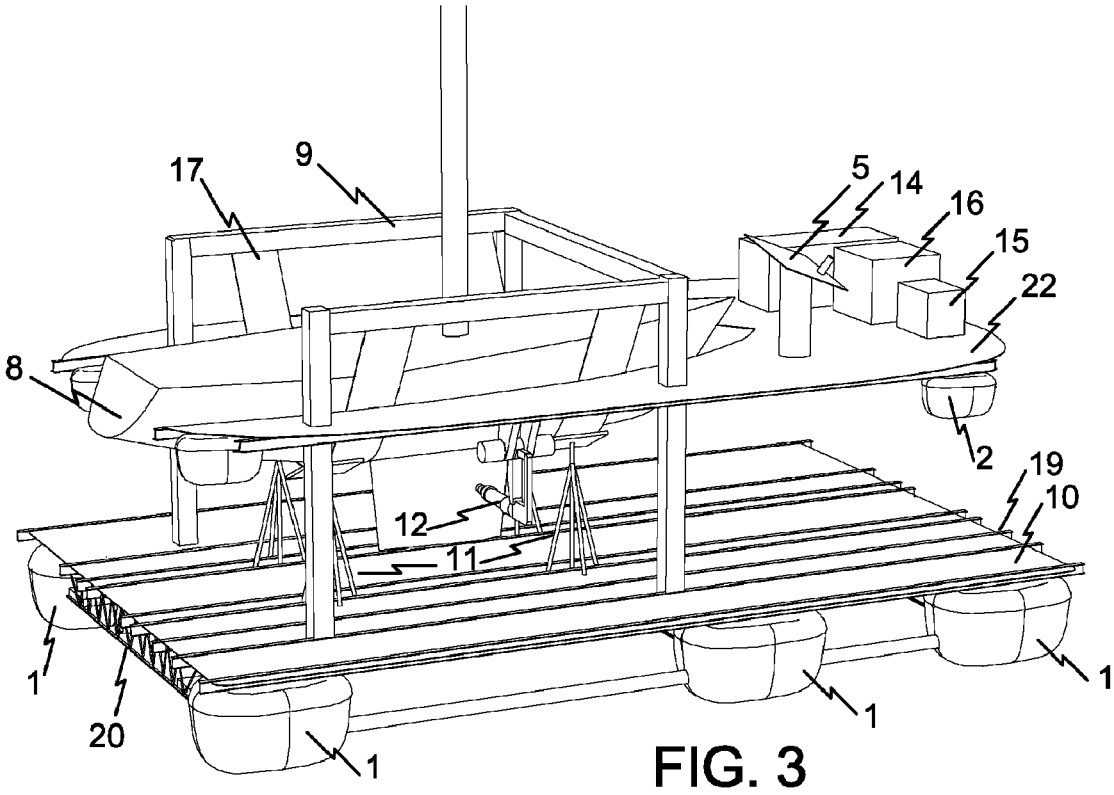
FIG. 3 is a perspective view (starboard side). In this view, the superstructure has been removed to show the components inside the PDD.

With reference now to FIG. 3, the PDD also includes a cabin 5. The cabin 5 is primarily used to house the controls to maneuver the PDD. It is positioned in the second level deck to maximize the visibility during submersion and lifting operations. A lifting frame 9 is used to support the straps 17 to lift the boat out of the water. It consists of a "U" shape frame that is elevated from the deck 10. A set of hull supports 11 can be positioned in multiple parts of the deck 10 to accommodate different hull shapes and sizes. These supports 11 are use to hold the RV 8 in position after the lifting straps 17 are removed.

With continuing reference to FIG. 3, a deck 10 completes the isolation of the working area from the outside environment. It creates a barrier between the working area and the surface of the water, stopping any contaminating material to come in contact with IW. A waste water collection system 25 shown in FIG. 15 captures the water used to service the RVs. This easy to clean deck, supports the RV 8 being repaired and the necessary equipment for the service.

A propulsion system consisting of a set of thrusters 7 is used to maneuver the PDD at low speeds when it is above the water or semi-submerged. Additionally, one or more engines are used for longer transportation needs.

With continuing reference to FIG. 3, a second level deck is a separated portion of the PDD to keep the equipment outside of the water when the rest of the PDD is submerged. This structure stores the utility equipment separated from the working area. It also provides a noise and vibration barrier to the work area. The second level deck 22, supports the air conditioning equipment 16, electrical generator 15, air compressor 14, vacuum pumps, and other equipment necessary for the service operation. It may also include welding, sanding, sand-blasting, cleaning and painting equipment. The air compressor 14, supplies air to control the PDD level in the water. The air compressor 14 is connected to the individual buoyant members 1 through a network of hoses and valves that control the flow of air to the buoyant members 1. In addition compressed air is used for painting, cleaning and controlling operations.

As shown in FIG. 3, an integrated hull surface treatment device 12 is located on deck to improve the efficiency of the operation. This device is a robotic arm that performs constant speed movements along the hull of the RV 8, keeping the working tool parallel to the hull surface. The working head can be exchanged to operate as a sander, pressure washer, sand-blaster or painting machine. An alternative to this embodiment is to perform the task manually or with the aid of power tools.

Figure 10:
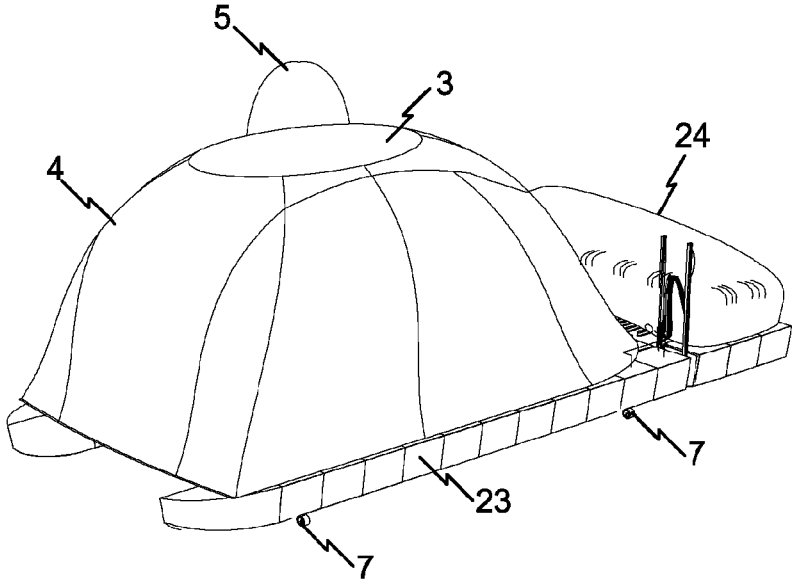
FIGS. 10 and 11 show one alternative to the embodiment shown in FIG. 1-9
Figure 11:
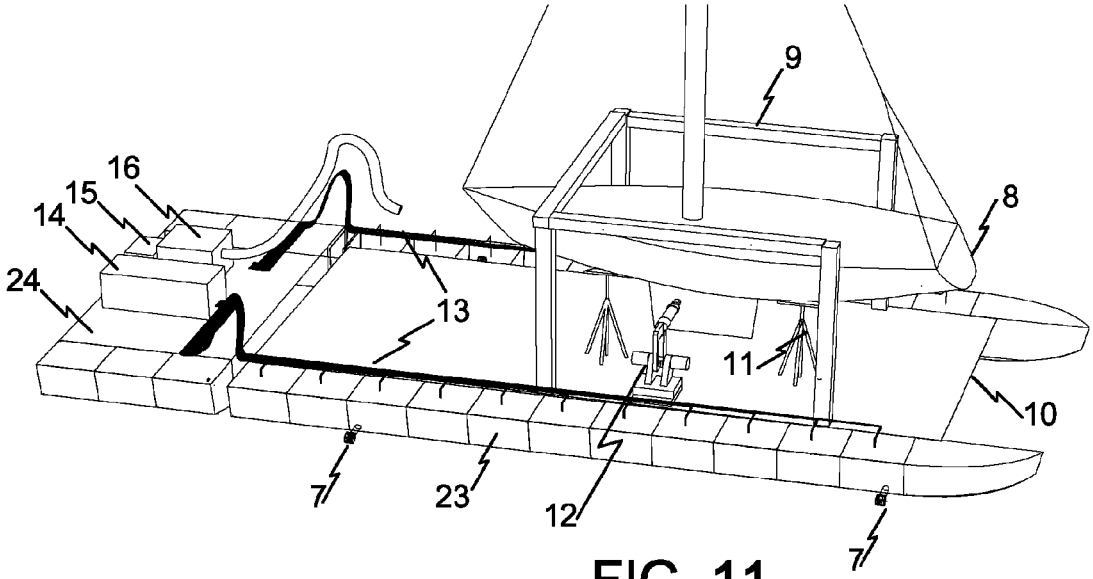

FIGS. 10 and 11 show one alternative to the embodiment shown in FIGS. 1-9. In FIG. 10 the buoyant members 1 are replaced by two pontoons consisting of individual chambers 23 attached together by a linking device e.g. screws, bolts, rods or clevis.

Figure 12:
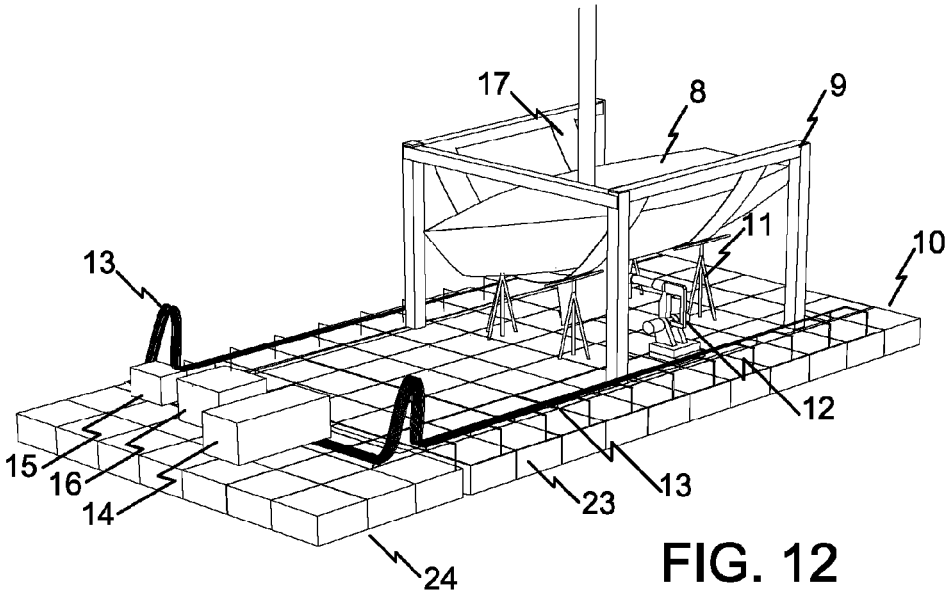
FIG. 12 shows a second alternative to the embodiment shown in FIG. 1-9

FIG. 12 shows another alternative comprised of multiple floating chambers linked to provide the lift and stability for the PDD. Another variation of these two alternative designs (FIG. 10 to 12) is that they have a separate floating structure (Utility boat 24) to keep the equipment dry when the PDD is submerged.

Figure 13:
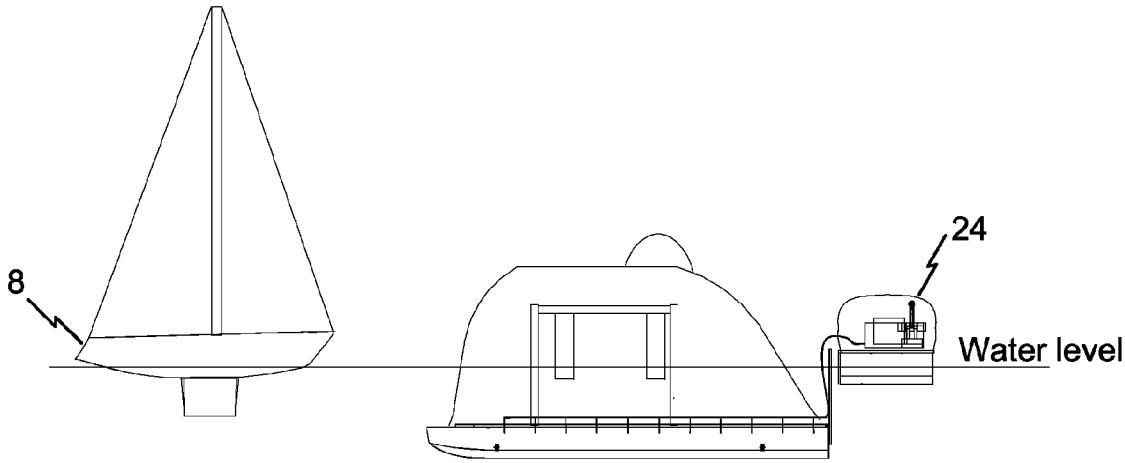
FIGS. 13 and 15 shows how the alternative embodiment uses a utility boat to keep the auxiliary equipment out of the water when the PDD is submerged.
Figure 14:
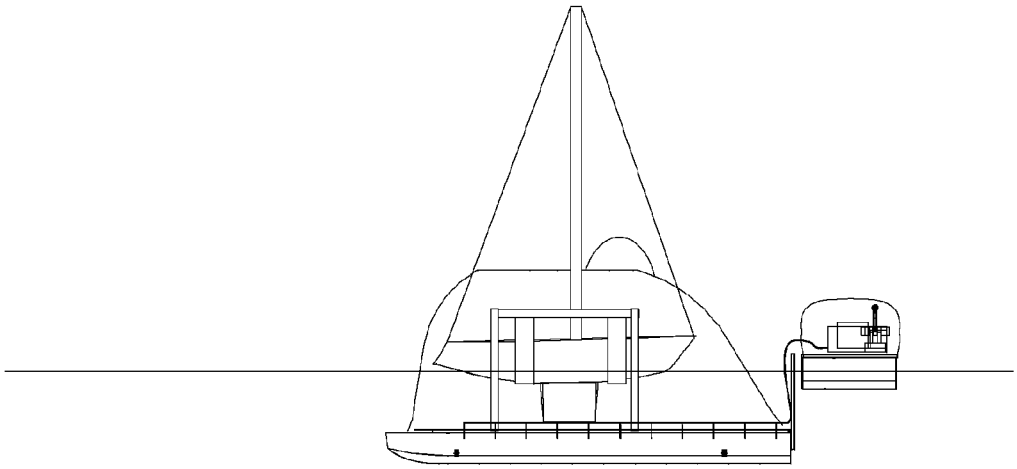

FIGS. 13 and 14 show how a separate utility boat 24 keeps the auxiliary equipment outside the water using one of the alternative configurations.

The preferred embodiment has distinctive benefits such as low construction cost, portability, stability, and can accommodate multiple types of hulls including sailboats and powerboats.

Figure 15:
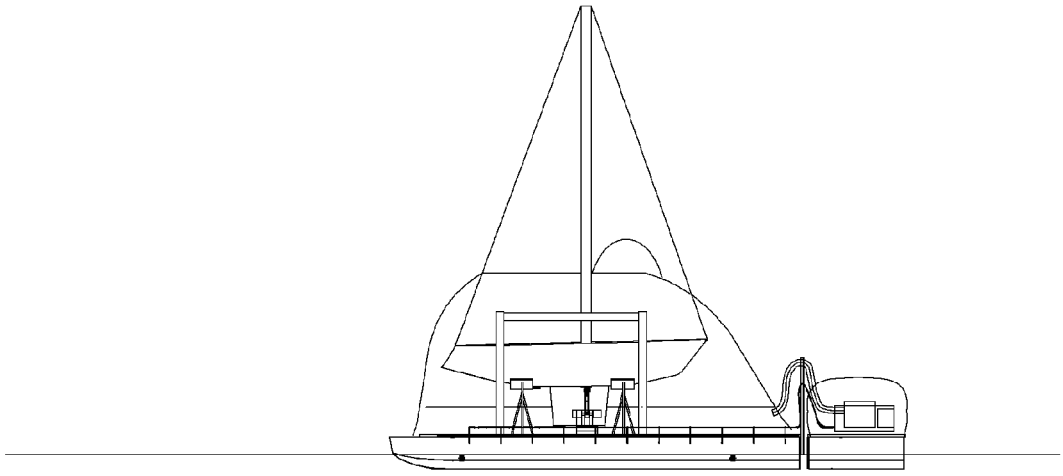
Figure 16:
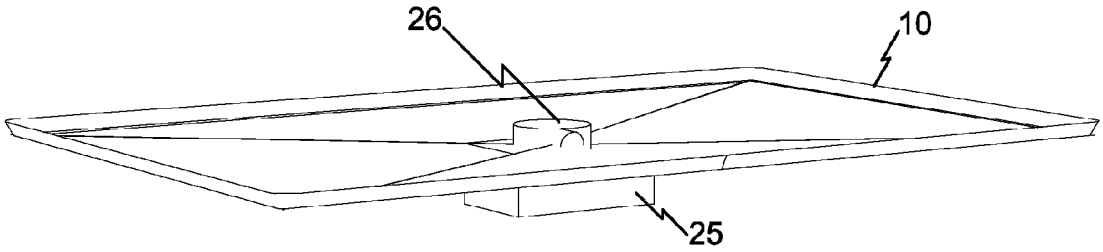
FIG. 16 is a perspective of the waste water collection system

FIG. 15 shows a perspective of the waste water collection system. This system collects the water from the deck into a waste water tank. The waste water tank 25 is located under the deck level, so water gets into the tank 25 by gravity through a waste water intake 26.

Operation of the PDD

Referring to FIGS. 6-9, the first step in the operation is to prepare the PDD for submersion by opening the roof and aft door. All the equipment inside the main shell is removed, leaving just the lifting frame 9 and the straps 17. In a second step, FIG. 7, the PDD is submerged by flooding the primary buoyant members 1. A vacuum is created through the compressed air conduits to accelerate the water filling the primary buoyant members.

Once submerged, the PDD 1 is placed under the RV 8 to be lifted. A system of thrusters 7 is used to position the PDD 1 bellow the RV 8. The RV 8 is then positioned inside the lifting frame 9. Two straps 17 are laid under the RV 8 and tied to the lifting frame 9. At this point, the PDD 1 is lifted and stabilized above the water surface. This process is done by injecting compressed air through the air conduits 13 into the individual primary buoyant members 1. Compressed air has to be injected selectively to the chambers to keep the PDD 1 leveled and stable.

Once the PDD 1 is back on the water surface, the roof 3 is closed to begin the service of the RV 8. Supports are positioned below the hull of the RV 8 and are locked to the deck with the use of pins. At this time, the lifting straps 17 can be removed.

At this stage, service can be performed on the RV 8, such as washing, cleaning, sanding and painting—in an isolated environment. Hazardous substances can be easily kept isolated from workers and the environment to be properly disposed.

The use of an integrated hull surface treatment device 12 improves the efficiency and the speed of the different operations of washing, sanding, cleaning and painting. This device can be programmed to follow the shape of the hull at constant speed and keeping the different tools parallel to the hull's surface with constant pressure.

After the service of the RV 8 is completed, the RV 8 is supported with the straps and all the equipment is removed from the main shell in preparation for submersion.

In the last step the serviced RV 8 is returned to the water.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

What is claimed is:

1. A navigable Portable Dry Dock (PDD) system that creates a controlled environment for commercial servicing of recreational vessels (RV), the PDD system comprising:

one or multiple buoyant members that provide sufficient lift to support the navigable PDD system and the RV over the water surface, a lifting frame or support blocks where the RV is positioned for servicing, a superstructure that includes one or more decks supporting the said lifting frame or support blocks, a control panel or cabin from where the PDD is controlled, a system to control the environment inside the superstructure, including a roof, air filtering and air conditioning equipment, and a framing system which provides a solid connection amongst the said buoyant members, the said superstructure, the said control panel or cabin, and the said support blocks or frame creating a solid structure where the RV is serviced.

2. The PDD system according to claim 1, wherein the buoyant members are modular and/or portable.

3. The PDD system according to claim 1, further comprising a propulsion system including one or more propellers or thrusters for maneuvering the PDD above and below water.

4. The PDD system according to claim 1, further comprising a buoyancy control system that regulates the lift by adding or removing water ballast into/from the said buoyant member.

5. The PDD system according to claim 1, further comprising of a waste collection system, including a leak proof deck that collects the waste water, sanding dust and other waste material produced during maintenance work, into a waste tank for avoiding any contaminant substance coming from the RV to enter the waterway.

6. The PDD system according to claim 1, wherein the superstructure, and the roof create a conditioned environment to protect the work from the elements and minimize the impact to the environment.

7. The PDD system according to claim 1, wherein the buoyant members can be added or removed to the PDD to increase or decrease lifting capacity.

8. The PDD system according to claim 1, including auxiliary equipment attached to the deck of the PDD, comprising:

a hull surface treatment device including a robotic arm configured to clean, sand or paint the hull, a compressor, to supply compressed air to the surface treatment device, and air conditioning equipment, to keep the inside of the PDD at a predetermined temperature and humidity.

9. A method for servicing RVs in inland waterways comprising:

navigating a PDD to where a RV is, positioning the PDD under the RV by submerging the PDD below the floating RV, strapping the RV into a lifting frame or support blocks, lifting the PDD and the RV above the water level, positioning hull supports under the RV, removing a lifting strap, servicing the RV in a climate controlled environment, placing the lifting straps back under the RV, removing the hull supports, submersing the PDD, and moving the RV out of the PDD.

* * * * *